US005503965A

United States Patent [19]

Okutsu

[11] Patent Number: 5,503,965

[45] Date of Patent: Apr. 2, 1996

[54] PROCESS FOR DEVELOPMENT OF BLACK-AND-WHITE- SILVER HALIDE PHOTOGRAPHIC MATERIAL

[75] Inventor: Eiichi Okutsu, Ashigara, Japan

[73] Assignee: Fuji Photo Film Co., Ltd., Kanagawa, Japan

[21] Appl. No.: 312,804

[22] Filed: Sep. 27, 1994

[30] Foreign Application Priority Data

Sep. 27, 1993 [JP] Japan ..... 5-239755

[51] Int. Cl.[6] ..... G03C 5/18; G03C 5/26

[52] U.S. Cl. ..... 430/399; 430/435; 430/440; 430/483; 430/488; 430/489; 430/490

[58] Field of Search ..... 430/399, 435, 430/436, 440, 482, 483, 488, 489, 490

[56] References Cited

U.S. PATENT DOCUMENTS

| | | | |
|---|---|---|---|
| 2,688,548 | 9/1954 | Reynolds | 430/488 |
| 2,688,549 | 9/1954 | James et al. | 430/483 |
| 3,022,168 | 2/1962 | Stjarnkvist | 430/482 |
| 3,337,342 | 8/1967 | Green | 430/435 |
| 3,600,176 | 8/1971 | Haist et al. | 430/483 |
| 3,658,527 | 4/1972 | Kunz et al. | 430/436 |
| 3,870,479 | 3/1975 | Kubotera et al. | 430/490 |
| 4,310,622 | 1/1982 | Onda et al. | 430/488 |
| 4,668,605 | 5/1987 | Okutsu et al. | 430/489 |
| 5,098,819 | 3/1992 | Knapp | 430/436 |
| 5,196,298 | 3/1993 | Meeus et al. | 430/440 |
| 5,236,816 | 8/1993 | Purol et al. | 430/436 |
| 5,264,323 | 11/1993 | Purol et al. | 430/436 |
| 5,278,035 | 1/1994 | Knapp | 430/436 |
| 5,376,510 | 12/1994 | Parker et al. | 430/440 |
| 5,385,811 | 1/1995 | Hirano | 430/488 |

FOREIGN PATENT DOCUMENTS

| | | | |
|---|---|---|---|
| 0529526 | 3/1993 | European Pat. Off. | 430/483 |
| 0585792 | 3/1994 | European Pat. Off. | 430/399 |
| 0588408 | 3/1994 | European Pat. Off. | 430/483 |
| 1117386 | 11/1961 | Germany | 430/436 |
| 2004893 | 8/1971 | Germany | 430/399 |
| 59-191035 | 10/1984 | Japan | 430/440 |
| 4-29233 | 1/1992 | Japan | 430/440 |
| 5-241281 | 9/1993 | Japan | 430/483 |
| 5-232641 | 9/1993 | Japan | 430/483 |
| 875453 | 8/1961 | United Kingdom | 430/435 |

OTHER PUBLICATIONS

T. H. James and W. Vanselow, "The Kinetics of Development by 1–Phenyl–3–Pyrazolidone", PSA Technical Quarterly, Aug. 1954, pp. 77–80.

*Primary Examiner*—Charles L. Bowers, Jr.
*Assistant Examiner*—J. Pasterczyk
*Attorney, Agent, or Firm*—Sughrue, Mion, Zinn, Macpeak & Seas

[57] ABSTRACT

The present invention improves the running stability of a developer comprising an ascorbic acid instead of hydroquinone as a developing agent. The present invention provides a process for development of a black-and-white silver halide photographic material, which comprises use of a development replenisher for black-and-white silver halide photographic material comprising an ascorbic acid and/or derivative thereof which has a pH value of at least 0.5 higher than that of the development starting solution.

9 Claims, No Drawings

PROCESS FOR DEVELOPMENT OF BLACK-AND-WHITE- SILVER HALIDE PHOTOGRAPHIC MATERIAL

FIELD OF THE INVENTION

The present invention relates to a process for development of a silver halide photographic material. More particularly, the present invention relates to a process for developing a black-and-white photographic(light-sensitive) material with a developing agent different from hydroquinone using an automatic developing machine.

BACKGROUND OF THE INVENTION

A commonly used black-and-white silver halide photographic material (for X-ray, plate-making, microphotography, negative, etc.) is conventionally developed with an alkaline developer comprising hydroquinone as a developing agent and a 3-pyrazolidone compound or aminophenol compound as an auxiliary developing agent, and then subjected to fixing and rinsing (stabilization) to form an image thereon. In this development process, a high active developer containing a large amount of hydroquinone as a developing agent is used. In the conventional method, such a developer is replenished in a large amount in spite of air oxidation to maintain its high activity. However, hydroquinone has been at issue due to its safety. A sulfite used for the prevention of oxidation of hydroquinone causes a silver halide to be dissolved in the developer. The silver halide is then reduced to silver which then occurs so-called silver stain. Thus, alternatives to hydroquinone have been required. One of alternative approaches is to use an ascorbic acid and/or its derivative as developing agents. However, an ascorbic acid and its derivative have been known disadvantageous in that when oxidized in an alkaline developer, they produce an acid to lower the pH value of the developer and that when used to develop a silver halide photographic material, the pH drop of the developer is great as compared with use of hydroquinone.

SUMMARY OF THE INVENTION

An object of the present invention is to obtain photographic performance with a good running stability by using an ascorbic acid and/or its derivative instead of hydroquinone as a developing agent for the development of a black-and-white silver halide photographic material.

Another object of the present invention is to obtain photographic performance with a good running stability and less silver stain at a small replenishment rate per unit area of silver halide photographic material.

These and other objects of the present invention will become more apparent from the following detailed description and examples.

The foregoing objects of the present invention are accomplished by a process for development of a black-and-white silver halide photographic material, which comprises use of an alkaline development replenisher for black-and-white silver halide photographic material comprising an ascorbic acid and/or derivative thereof which has a pH value of at feast 0.5, preferably at least 0.7 higher than that of a development starting solution. The foregoing objects of the present invention are also accomplished by a process for development of a black-and-white silver halide photographic material, which comprises use of a development replenisher for black-and-white photographic material comprising an ascorbic acid and/or derivative thereof which has a pH value of at least 0.3 higher than that of a development starting solution and contains a carbonate in an amount of not less than 0.5 mol/l.

DETAILED DESCRIPTION OF THE INVENTION

The emulsion grains used in the present invention will be described hereinafter. The average diameter of spheres having the same volume as the emulsion grains (hereinafter referred to as "average grain size corresponding to grain size of sphere") is preferably in the range of from not less than 0.2 μm to less than 2.0 μm, particularly from not less than 0.5 μm to less than 1.5 μm. The grain size distribution is preferably narrow. The silver halide grains in the emulsion may have a regular crystal form such as cube (preferably monodispersed cubic grain with a grain size of 0.4 μm or less), octahedron and tetradecahedron or an irregular crystal form such as sphere, tabular form and pebble-like form. The emulsion may consist of a mixture of grains having various crystal forms. Tabular grains having a grain length of 5 or more times a grain thickness may be preferably used in the present invention (as further described in Research Disclosure vol. 225, Item 22,534, pp. 20–58, January 1983, JP-A-58-127921 (The term "JP-A" as used herein means an "unexamined published Japanese patent application"), JP-A-58-113926). The preparation of tabular silver halide grains can be accomplished by effecting methods known in the art in a proper combination. An emulsion of tabular silver halide grains can be easily prepared by referring to methods as described in JP-A-58-127921, JP-A-58-113927, JP-A-58-113928, and U.S. Pat. No. 4,439,520. The diameter of projected area of tabular grains according to the present invention is preferably in the range of 0.3 to 2.0 μm, particularly 0.5 to 1.2 μm. Further, the distance between parallel planes (grain thickness) is preferably in the range of 0.05 to 0.3 μm, particularly 0.1 to 0.25 μm. The aspect ratio of tabular grains is preferably in the range of from not less than 3 to less than 20, particularly from not less than 4 to less than 8. The emulsion of tabular silver halide grains according to the present invention preferably comprises silver halide grains having an aspect ratio of not less than 2 in a proportion of not less than 50%, particularly not less than 70% of all grains as calculated in terms of projected area. The average aspect ratio of the tabular grains is preferably not less than 3 to less than 20, particularly from 4 to 8. Particularly useful among tabular silver halide grains are monodispersed hexagonal tabular grains. For the details of structure and preparation method of monodispersed hexagonal tabular grains as defined herein, reference can be made to JP-A-63-151618.

In the present invention, the amount of the silver halide coated on both sides of the photographic material is not more than 3.5 g per $m^2$ as silver content.

In order to make an effective utilization of the effects of the present invention, conventional selenium compounds as disclosed in prior patents may be used as selenium sensitizers. As non-unstable selenium compounds which can be used in the present invention, compounds as disclosed in JP-B-46-4553 (The term "JP-B" as used herein means an "examined Japanese patent publication"), JP-B-52-34492, and JP-B-52-34491 can be used. Examples of such the non-unstable selenium compounds include selenious acid, potassium selenocyanide, selenazoles, quaternary salts of selenazoles, diaryl selenide, diaryl diselenide, dialkyl selenide, dialkyl diselenide, 2-selenazolidine dione, 2 -selenoxazolidine thion, and derivatives thereof.

Examples of silver halide solvents which can be used in the present invention include (a) organic thioethers as disclosed in U.S. Pat. Nos. 3,271,157, 3,531,289, 3,574,628, JP-A-54-1019, and JP-A-54-158917, (b) thiourea derivatives as disclosed in JP-A-53-82408, JP-A-55-77737, and JP-A-55-2982, (c) silver halide solvents having a thiocarboxyl group interposed between an oxygen atom or sulfur atom and a nitrogen atom as disclosed in JP-A-53-144319, (d) imidazoles as disclosed in JP-A-54-100717, (e) sulfites, and (f) thiocyanates. Particularly preferred among these silver halide solvents are thiocyanate and tetramethylthiourea. The amount of the solvent to be used depends on the kind thereof. If the solvent is thiocyanate, the amount thereof is preferably in the range of from not less than $1\times10^{-4}$ mol to not more than $1\times10^{-2}$ mol per mol of silver halide. The silver halide photographic emulsion according to the present invention can be subjected to sulfur sensitization and gold sensitization, singly or in combination, as chemical sensitization to attain a high sensitivity and reduce the formation of fog. Sulfur sensitization is normally effected by stirring the emulsion with a sulfur sensitizer at a high temperature, preferably not lower than 40° C. for a predetermined period of time. Gold sensitization is normally effected by stirring the emulsion with a gold sensitizer at a high temperature, preferably not lower than 40° C. for a predetermined period of time. As the sulfur sensitizer which can be used in the foregoing sulfur sensitization, well-known compounds such as thiosulfate, thiourea, allylisothiocyanate, cystine, p-toluenethiosulfonate and rhodanine can be used. In addition, sulfur sensitizers as disclosed in U.S. Pat. Nos. 1,574,944, 2,410,689, 2,278,947, 2,728,668, 3,501,313, 3,656,955, German Patent 1,422,869, JP-B-56-24937, and JP-A-55-45016 can be used. The amount of the sulfur sensitizer to be added may be such that the sensitivity of the emulsion can be effectively raised. The amount of the sulfur sensitizer to be added varies widely with various conditions such as pH, temperature and size of silver halide grains. It is in the range of preferably from not less than $1\times10^{-7}$ mol to not more than $5\times10^{-4}$ mol and particularly preferably from not less than $1\times10^{-6}$ mol to not more than $1\times10^{-4}$ mol.

As the foregoing gold sensitizer to-be used in gold sensitization a gold compound commonly used as a gold sensitizer whose oxidation number may be either +1 valence or +3 valence can be used. Examples of such the gold compound include chloroaurate, potassium chloroaurate, auric trichloride, potassium auric thiocyanate, potassium iodoaurate, tetracyanoauric acid, ammonium aurothiocyanate, and pyrydil trichloroaurate. The amount of such the gold sensitizer to be added varies with various conditions. In general, it is in the range of preferably from not less than $1\times10^{-7}$ mol to not more than $5\times10^{-4}$ mol, particularly preferably from not less than $1\times10^{-6}$ mol to not more than $1\times10^{-4}$, per mol of silver halide.

In order to make effective utilization of the effects of the present invention, a silver halide-adsorbing substance is preferably allowed to present in the system during the chemical sensitization of the emulsion in the preparation of the emulsion in an amount of not less than 0.5 mmol per mol of silver halide as described in JP-A-2-68539. The addition of the silver halide-adsorbing substance may be effected at any time, e.g., during the formation of grains, immediately after the formation of grains, before or after the beginning of chemical ripening. It is preferably effected before or at the same time with the addition of a chemical sensitizer (e.g., gold or sulfur sensitizer). Such the silver halide-adsorbing substance needs to be present at least in progress of the chemical sensitization. The silver halide-adsorbing substance may be added at any temperature between 30° C. and 80° C. Preferably, it is between 50° C. and 80° C. for the purpose of enhancing the adsorbing properties of the silver halide-adsorbing substance. The addition of the silver halide-adsorbing substance may be effected at any pH and pAg values. However, chemical sensitization is preferably effected at a pH value of 5 to 10 and a pAg value of 7 to 9.

The term "silver halide-adsorbing substance" as used herein means a sensitizing dye or photographic performance stabilizer. Examples of such the silver halide-adsorbing substance include azoles such as benzothiazolium salt, benzoimidazolium salt, imidazole, benzimidazole, nitroindazole, triazole, benzotriazole, tetrazole and triazine; mercapto compounds such as mercaptothiazole, mercaptobenzothiazole, mercaptoimidazole, mercaptobenzimidazole, mercaptobenzooxazole, mercaptothiadiazole, mercaptooxadiazole, mercaptotetrazole, mercaptopyrimidine and mercaptotriazine; thioketo compounds such as oxazolinethione; azaindenes such as triazaindene, tetraazaindene (particularly 4-hydroxy-substituted (1,3,3a,7)tetraazaindene) and pentaazaindene; and many other compounds known as fog inhibitors or stabilizers. Further as another adsorbing substance which may be used in the present invention, substances such as purines, nucleic acids, and high molecular compounds as disclosed in JP-B-61-36213, and JP-A-59-90844 may be also used.

As a silver halide-adsorbing substance, a sensitizing dye may achieve desirable effects. Examples of a sensitizing dye which can be used in the present invention include cyanine dye, melocyanine dye, complex cyanine dye, complex melocyanine dye, holopolar cyanine dye, styryl dye, hemicyanine dye, oxonol dye, and hemioxonol dye. Examples of useful sensitizing dyes which can be used in the present invention are described in U.S. Pat. Nos. 3,522,052, 3,619,197, 3,713,828, 3,615,643, 3,615,632, 3,617,293, 3,628,964, 3,703,377, 3,666,480, 3,667,960, 3,679,428, 3,672,897, 3,769,026, 3,556,800, 3,615,613, 3,615,638, 3,615,635, 3,705,809, 3,632,349, 3,677,765, 3,770,449, 3,770,440, 3,769,025, 3,745,014, 3,713,828, 3,567,458, 3,625,698, 2,526,632, and 2,503,776, JP-A-48-76525, and Belgian Patent 691,807.

The photographic emulsion layer or other hydrophilic colloidal layers of the photographic light-sensitive material prepared according to the present invention may contain various surface active agents for various purposes, e.g., as coating aids, as antistatic agents, for improvement of sliding properties, as emulsification and dispersing aids, for prevention of adhesion, for improvement of photographic properties (e.g., development acceleration, increase in contrast and increase in sensitivity).

As binder or protective colloid to be incorporated in the emulsion layer or interlayer and surface protective layer of the light-sensitive material of the present invention, gelatin can be advantageously used. Other hydrophilic colloids can be also used. For example, proteins such as gelatin derivative, graft polymer of gelatin and other high molecular compounds, albumin and casein; cellulose derivatives such as hydroxyethyl cellulose, carboxymethyl cellulose and cellulose sulfuric ester; saccharide derivatives such as sodium alginate, dextran and starch derivative, and various synthetic hydrophilic high molecular compounds such as single polymer and copolymer, e.g., polyvinyl alcohol, polyvinyl alcohol partial acetal, poly-N-vinyl pyrrolidone, polyacrylic acid, polymethacrylic acid, polyacrylamide, polyvinyl imidazole, and polyvinyl pyrazole. As gelatin, lime-processed gelatin as well as acid-processed gelatin and enzyme-processed gelatin may be used, and gelatin hydrolyzate and enzymatic decomposition product of gelatin may be also used. Gelatin may be preferably used in combination with dextran or polyacrylamide having an average molecular weight of not more than 50,000. Methods as disclosed in JP-A-63-68837 and JP-A-63-149641 are effective also in the present invention.

The photographic emulsion and light-insensitive hydrophilic colloid of the present invention may contain inorganic or organic film hardener. For example, chromium salts (e.g., chrome alum, chromium acetate), aldehydes (e.g., formaldehyde, glyoxal, glutaraldehyde), N-methylol compounds (e.g., dimethylolurea, methylol dimethylhydantoin), dioxane derivatives (e.g., 2,3-dihydroxydioxane), activated vinyl compounds (e.g., 1,3,5-triacryloyl-hexahydro-s-triazine, bis(vinylsulfonyl)methylether, N,N-methylenebis-[β-(vinylsulfonyl)propionamide]), activated halogen compounds (e.g., 2,4-dichloro-6-hydroxy-s-triazine), mucohalogenic acids (e.g., mucochloric acid, mucophenoxychloric acid), isooxazoles, dialdehyde starch, and 2-chloro-6 -hydroxytriazinylated gelatin may be used singly or in combination. In particular, activated vinyl compounds as disclosed in JP-A-53-41221, JP-A-53-57257, JP-A-59-162546, JP-A-60-80846 and activated halides as disclosed in U.S. Pat. No. 3,325,287 are preferred.

The hydrophilic colloidal layer in the photographic material according to the present invention is preferably hardened by a film hardener such that the swelling rate thereof as determined in water is preferably not more than 280% and more preferably 150 to 280%. The swelling rate in water as defined herein is determined by freeze-drying method. In some detail, the photographic material is aged under the conditions of 25° C. and 60% RH for 7 days before the measurement for swelling rate of the hydrophilic colloidal layer. The dry thickness (a) of the photographic material is determined by measuring a section thereof under a scanning electron microscope. The swelled thickness (b) is determined by dipping the photographic material in distilled water at a temperature of 21° C. for 3 minutes, freeze-drying the material, and then observing the material with a scanning electron microscope. The swelling rate is obtained by the following formula:

$$\{(b)-(a)\}\times 100/(a)\ (\%)$$

The emulsion layer of the photographic material according to the present invention may comprise a polymer or plasticizer (e.g., emulsion) incorporated therein for the purpose of improving the pressure properties thereof. For example, British Patent 738,618 discloses use of a heterocyclic compound. British Patent 738,637 discloses use of an alkyl phthalate. British Patent 738,639 discloses use of an alkyl ester. U.S. Pat. No. 2,960,404 discloses use of a polyvalent alcohol. U.S. Pat. No. 3,121,060 discloses use of a carboxyalkyl cellulose. JP-A-49-5017 discloses use of paraffin and carboxylate. JP-A-53-28086 discloses use of an alkyl acrylate and organic acid. Other constitutions of the emulsion layer of the silver halide photographic material according to the present invention are not specifically limited. Various additives may be incorporated in the emulsion layer as necessary. For example, binders, surface active agents, other dyes, coating aids, thickening agents, etc. as described in Research Disclosure vol. 176, pp. 22–28 (December 1978) may be used.

A silver halide photographic material comprising a photographic emulsion layer on both sides thereof has disadvantage that image deterioration is easily generated by crossover light. The crossover light is emitted by the respective sensitizing screen positioned on the both sides of the light-sensitive material and then transmitted by the support (normally as thick as 170 to 180 μm) for the light-sensitive material to reach the photosensitive layer on the opposite side thereof. The crossover light causes a deterioration of image quality (particularly sharpness).

The less the crossover light is, the sharper is the resulting image. There are various ways of reducing the crossover light. The most preferred way is to fix a decolorable dye between the support and the photosensitive layer by development. The use of a fine crystalline dye as taught in U.S. Pat. No. 4,803,150 is very desirable because this dye can be well fixed and decolored and can be used in a large amount to reduce the crossover light. This approach causes no desensitization due to failure of fixing and enables decoloration of the dye by a 90-second processing, reducing the crossover by more than 85%.

More preferably, the dye layer for reducing the crossover light comprises a dye in a concentration as high as possible. The coated amount of gelatin used as a binder is preferably reduced such that the thickness of the dye layer is not more than 0.5 μm. However, since the extreme reduction of the layer thickness can easily cause poor contact, the preferable thickness of the dye layer is in the range of 0.05 to 0.3 μm.

The size distribution of silver halide grains may be narrow or wide. A so-called monodispersed emulsion is preferred in photographic properties such as latent image stability and pressure resistance and processing stability such as pH dependence of developer. The value S/d obtained by dividing the standard deviation S of diameter distribution of silver halide grains by the average diameter thereof as calculated in terms of circle having the same area as the projected area of silver halide grains is preferably not more than 20%, more preferably not more than 15%.

The preparation of silver chloride, silver bromochloride or silver bromochloroiodide emulsion to be used in the present invention can be accomplished by any suitable method as disclosed in P. Glafkides, "Chimie et Physique Photographique", Paul Montel, 1967, G. F. Duffin, "Photographic Emulsion Chemistry", The Focal Press, 1966, and V. L. Zelikman et al., "Making and Coating Photographic Emulsion", The Focal Press, 1964. In some detail, the emulsion can be prepared by any of the acid process, the neutral process, the ammonia process, etc. In particular, the acid process and neutral process are preferred because they can minimize the formation of fog. The reaction between a soluble silver salt and a soluble halogen salt to obtain a silver halide emulsion can be carried out by any of a so-called single jet process, a so-called double jet process, a combination thereof, and the like. A method in which grains are formed in the presence of excess silver ions may be used. Further, a so-called controlled double jet process, in which a pAg value of a liquid phase in which silver halide grains are formed is maintained constant, is more preferred. According to the controlled double jet process, a silver halide emulsion having a regular crystal form and a narrow grain size distribution can be obtained.

In order to form high chloride content-silver grains, a method which comprises the use of a bispyridinium compound as described in JP-A-2-32, JP-A-3-137632, JP-A-4-6546, JP-A-5-53231, and JP-A-5-127279 and a method as described in JP-A-62-293536, JP-A-1-155332, JP-A-63-2043, JP-A-63-25643, U.S. Pat. Nos. 4,400,463 and 5,061,617 may be preferably used.

During the growth or physical ripening of the foregoing silver halide grains, cadmium salts, zinc salts, lead salts, thallium salts, iridium salts or complex salts thereof, rhodium salts or complex salts, iron salts or complex salts thereof, etc. may be present in the system.

During or after the grain formation, a silver halide solvent (e.g., known silver halide solvents such as ammonia, thiocyanate and thioethers and thione compounds as described in U.S. Pat. No. 3,271,157, JP-A-51-12360, JP-A-53-82408, JP-A-53-144319, JP-A-54-100717, and JP-A-54-155828) may be used. When used in combination with the foregoing method, such the silver halide solvent can provide a silver halide emulsion having a regular crystal form and a narrow grain size distribution.

The black-and-white photographic material prepared according to the present invention may contain a water-soluble dye in the hydrophilic colloidal layer as a filter dye or for the purpose of inhibiting irradiation and other various purposes. Examples of such the water-soluble dye include an oxonol dye, a hemioxonol dye, a styryl dye, a melocyanine dye, a cyanine dye, and an azo dye. Particularly useful among these dyes are an oxonol dye, a hemioxonol dye, and a melocyanine dye.

The support for the photographic material according to the present invention needs to have a thickness of 150 to 250 μm. This is essential in respect of handling property upon observation over a medical schaukasten (i.e., light table). The support is preferably a polyethylene terephthalate film. In particular, it is preferably colored blue.

The surface of the support is preferably subjected to corona discharge treatment, glow discharge treatment or ultraviolet-ray irradiation treatment to enhance the adhesivity to the hydrophilic colloidal layer. Alternatively, the support may comprise an undercoating layer made of a styrenebutadiene latex, chlorinated vinylidene latex or the like provided thereon. A gelatin layer may be further provided on the undercoating layer.

Alternatively, the support may comprise an under-coating layer made of an organic solvent containing a polyethylene swelling agent and gelatin provided thereon.

These undercoating layers may be subjected to surface treatment to further enhance the adhesivity to the hydrophilic colloidal layer.

As the various additives to be incorporated in the photographic material according to the present invention there can be used those tabulated below.

| Item | Where to find |
|---|---|
| 1) Chemical sensitization method | Line 13, upper right column-line 16, upper left column on page 10 of JP-A-2-68539; JP-A-5-313282 |
| 2) Fog inhibitor (Antifoggants), stabilizer | Line 17, lower left column,, page 10 - line 7, upper left column, page 11 and line 2, lower left column - lower left column, page 3 of JP-A-2-68539 |
| 3) Color tone improver | Line 7, lower left column, page 2 - line 20, lower left column, page 10 of JP-A-62-276539; line 15, lower left column, page 6 - line 19, upper right column, page 11 of JP-A-3-94249 |
| 4) Surface active agent, antistatic agent | Line 14, upper right column, page 11 - line 9, upper left column, page 12 of JP-A-2-68539 |
| 5) Matting agent, lubricant, plasticizer | Line 10, upper left column - line 10, upper right column, page 12 and line 10, lower left column - line 1, lower right column, page 14 of JP-A-2-68539 |

-continued

| Item | Where to find |
|---|---|
| 6) Hydrophilic colloid | Line 11, upper right column - line 16, lower left column, page 12 of JP-A-2-68539 |
| 7) Hardener | Line 17, lower left column, page 12 - line 6, upper right column, page 13 of JP-A-2-68539 |
| 8) Polyhydroxybenzene | Upper left column, page 11 - lower left column, page 12 of JP-A-3-39948; EP 452772A |
| 9) Layer configuration | JP-A-3-198041 |

The ascorbic acid or its derivative to be incorporated in the developer according to the present invention is preferably a compound represented by formula (III):

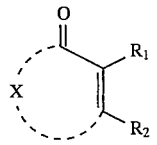

(III)

wherein $R_1$ and $R_2$ each represent a hydroxyl group, an amino group, an acylamino group, an alkylsulfonylamino group, an arylsulfonylamino group, an alkoxycarbonylamino group, a mercapto group or an alkylthio group; and X comprises carbon atom, oxygen atom or nitrogen atom and forms a 5- or 6 -membered ring with carbonyl carbon atom and vinyl carbon atom on which $R_1$ and $R_2$ substitute.

The formula (III) will be further described hereinafter.

In the formula (III), $R_1$ and $R_2$ each represent a hydroxyl group, an amino group (including substituted amino groups having as substituents an alkyl group with 1 to 10 carbon atoms such as methyl, ethyl, n-butyl and hydroxyethyl), an acylamino group (e.g., acetylamino, benzoylamino), an alkylsulfonylamino group (e.g., methanesulfonylamino), an arylsulfonylamino group (e.g., benzenesulfonylamino, p-toluenesulfonylamino), an alkoxycarbonylamino group (e.g., -methoxycarbonylamino), a mercapto group or an alkylthio group (e.g., methylthio, ethylthio). Preferred examples of $R_1$ and $R_2$ include a hydroxyl group, an amino group, an alkylsulfonylamino group, and an arylsulfonylamino group. X comprises carbon atom, oxygen atom or nitrogen atom and forms a 5- or 6-membered ring with carbonyl carbon atom and vinyl carbon atom on which $R_1$ and $R_2$ substitute. In some detail, X is formed by —O—, —$C(R_3)(R_4)$—, —$C(R_5)$=, —C(=O)—, —$N(R_6)$— and —N= in combination, provided that $R_3$, $R_4$, $R_5$ and $R_6$ each represent a hydrogen atom, an alkyl group with 1 to 10 carbon atoms which may be substituted by substituents such as hydroxyl, carboxyl and sulfo, an aryl group with 6 to 15 carbon atoms which may be substituted by substituents such as alkyl, halogen atom, hydroxyl, carboxyl and sulfo, a hydroxyl group or a carboxyl group. Further, the 5- or 6-membered ring may form a saturated or unsaturated condensed ring. Examples of such the 5- or 6-membered ring include a dihydrofuranone ring, a dihydropyrone ring, a pyranone ring, a cyclopentenone ring, a cyclohexenone ring, a pyrrolinone ring, a pyrazolinone ring, a pyridone ring, an azacyclohexenone ring, and a uracil ring. Preferred among these 5- or 6-membered rings are a dihydroxyfuranone ring, a cyclopentenone ring, a cyclohexenone ring, a pyrazolinone ring, an azacyclohexenone ring, and a uracil ring.

Specific examples of such a 5- or 6-membered ring will be given below.
A-1
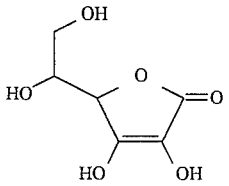
A-2
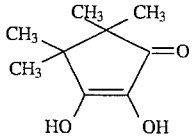
A-3
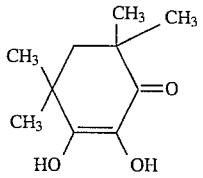
A-4
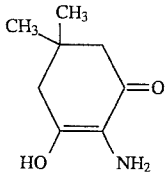
A-5
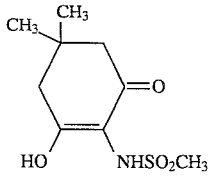
A-6
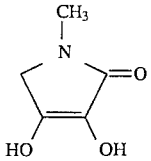
A-7
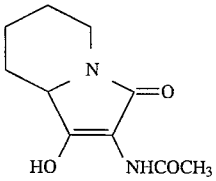
A-8
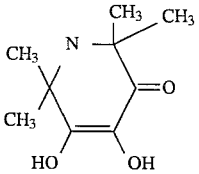
A-9
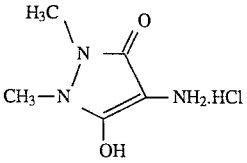
-continued
A-10
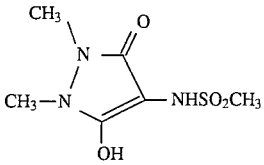
A-11
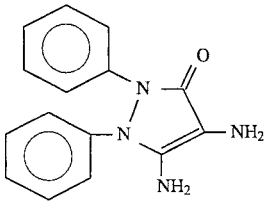
A-12
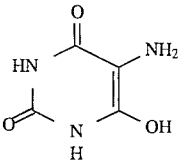
A-13
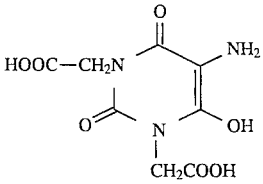
A-14
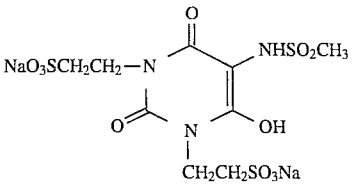
A-15
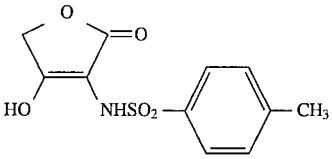
A-16
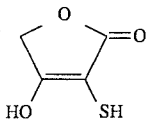
A-17
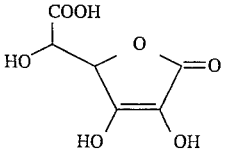
A-18
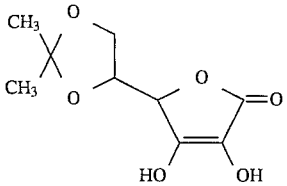

-continued

A-19

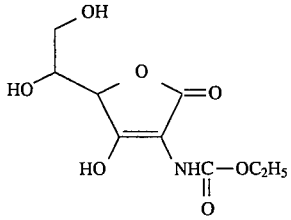

A-20

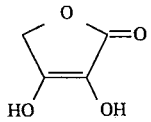

A-22

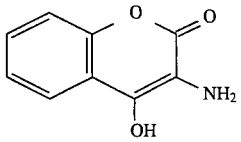

A-23

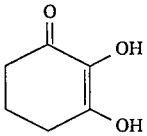

A-24

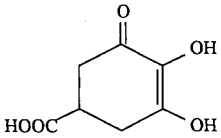

Referring to the ascorbic acid to be incorporated in the developer according to the present invention, endiol type ascorbic acid, enaminol type ascorbic acid, endiamin type ascorbic acid, thiol-enol type ascorbic acid and enamin-thiol type ascorbic acid are generally known. Examples of these compounds are described in U.S. Pat. No. 2,688,549, and JP-A-62-237443. Methods for the synthesis of these ascorbic acids are well-known. For the details of these methods, reference can be made to Tuguo Nomura and Hirohisa Omura, "Chemistry of Reductone", Uchida-Rokakuho Shinsha, 1969.

The ascorbic acid to be used in the present invention can be used in the form of alkaline metal salts such as a lithium salt, a sodium salt and a potassium salt. The preferred amount of the ascorbic acid to be used is in the range of 1 to 100 g, more preferably 5 to 80 g per l of the developer.

In the present invention, the developer preferably comprises a compound represented by formula (I) and/or a compound represented by formula (II) incorporated therein as a silver stain inhibitor to minimize the replenishment rate:

(I)

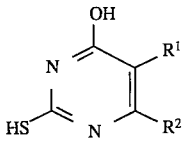

wherein $R^1$ and $R^2$ each represent a hydrogen atom, an unsubstituted or substituted alkyl group, an unsubstituted or substituted aryl group, an aralkyl group, a hydroxyl group, a mercapto group, a carboxy group, a sulfo group, a phosphono group, a nitro group, a cyano group, a halogen atom, an alkoxycarbonyl group, an aryloxycarbonyl group, a carbamoyl group, a sulfamoyl group or an alkoxy group, provided that the sum of the number of carbon atoms in $R^1$ and $R^2$ is in the range of 2 to 20; and $R^1$ and $R^2$ may be connected to each other to form a saturated ring structure;

(II)

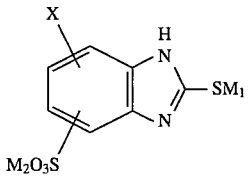

wherein X represents a hydrogen atom or a sulfonic group; $M_1$ represents a hydrogen atom or an alkaline metal atom; and $M_2$ represents a hydrogen atom, an alkaline metal atom or an ammonium group.

Specific examples of the compound represented by formula (I) of the present invention as a silver stain inhibitor will be given below, but the present invention should not be construed as being limited thereto.

(1)

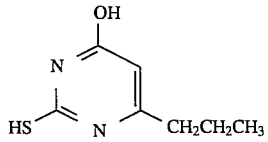

(2)

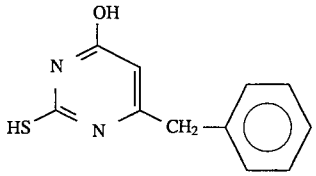

(3)

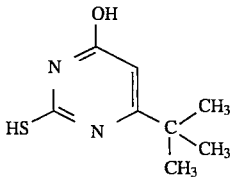

(4)

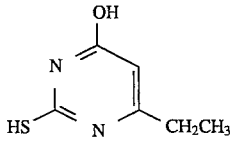

(5)

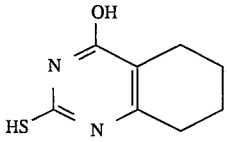

(6)

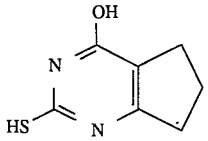

-continued (7)

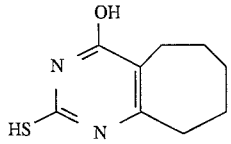

(8)

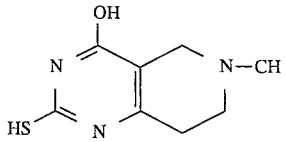

(9)

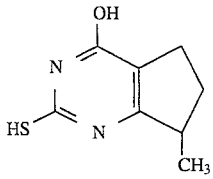

(10)

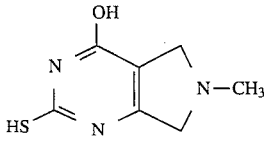

(11)

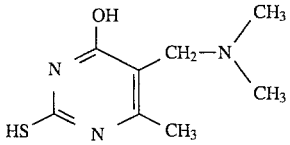

(12)

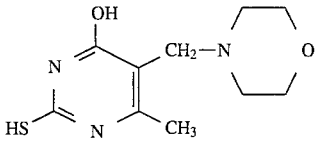

(13)

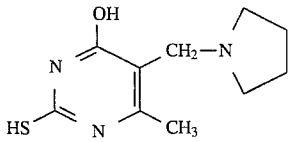

(14)

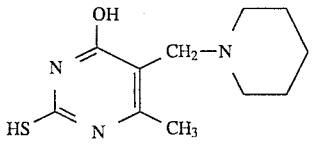

(15)

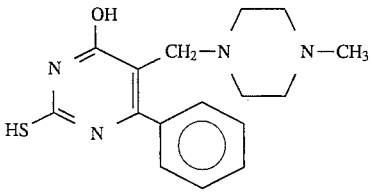

(16)

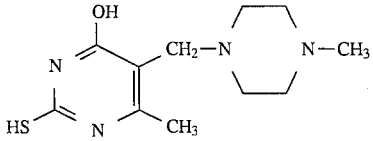

-continued (17)

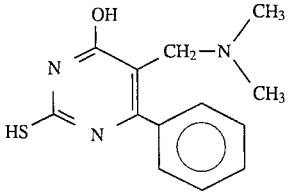

(18)

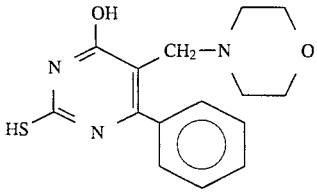

(19)

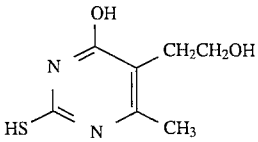

(20)

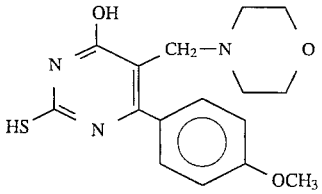

(21)

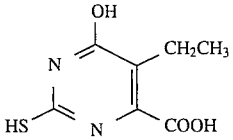

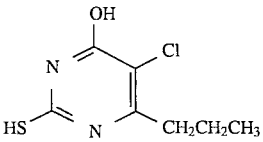

(22)

The synthesis of these compounds represented by formulae (I) and (II) can be easily accomplished by methods as described in "Comprehensive Heterocyclic Chemistry", vol. 3, pp.40–56, pp. 106–142, pp. 179–191, and "The Journal of American Chemical Society", vol. 67, pp. 2,197–2,200, 1945.

In the present invention, a compound represented by formula (II) can be used besides the compound represented by formula.(I). The compounds represented by formulae (I) and (II) may be used in combination.

Specific examples of the compound represented by formula (II) will be given below, but the present invention should not be construed as being limited thereto.

(23)

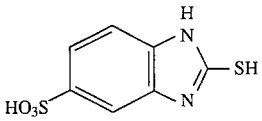

-continued

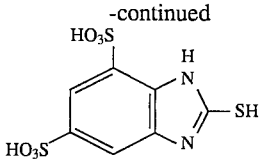

(24)

The concentration of the compounds represented by formulae (I) and (II) of the present invention in the developer (usable form) is preferably in the range of 0.01 to 50 mmol/l, more preferably 0.05 to 10 mmol/l, most preferably 0.1 to 5 mmol/l.

The developer to be used in the present invention may contain an amino compound to accelerate development. In particular, amino compounds as disclosed in JP-A-50-106244, JP-A-61-267759, and JP-A-2-208652 may be used.

In the present invention, development inhibitors such as potassium bromide and potassium iodide; organic solvents such as dimethylformamide, methyl cellosolve, hexylene glycol, ethanol and methanol; and benztriazole derivatives such as 5-methylbenztriazole, 5-bromobenztriazole, 5 -chlorobenztriazole, 5-butylbenztriazole and benztriazole may be used. Particularly preferred among these benztriazole derivatives is 5-methylbenztriazole. Examples of nitroindazoles to be used in the present invention include 5 -nitroindazole, 6-nitroindazole, 4-nitroindazole, 7 -nitroindazole, and 3-cyano-5-nitroindazole. Particularly preferred among these nitroindazoles is 5-nitroindazole.

Further, the developer may contain a color tone adjustor, a surface active agent, a hard water softener, a hardener, etc.

Examples of chelating agent to be incorporated in the developer include ethylenediamine diorthohydroxyphenylacetic acid, diaminopropanetetraacetic acid, nitrilotriacetic acid, hydroxyethylethylenediaminetriacetic acid, dihydroxyethylglycine, ethylenediaminediacetic acid, ethylenediaminedipropionic acid, iminodiacetic acid, diethylenetriaminepentaacetic acid, hydroxyethyliminodiacetic acid, 1,3 -diaminopropanoltetraacetic acid, triethylenetetraminehexaacetic acid, transcyclohexanediaminetetraacetic acid, ethylenediaminetetraacetic acid, glycoletherdiaminetetraacetic acid, ethylenediaminetetrakismethylenephosphonic acid, diethylenetriaminepentamethylenephosphonic acid, nitrilotrimethylenephosphonic acid, 1-hydroxyethylidene-1,1 -diphosphonic acid, 1,1-diphosphonoethane-2-carboxylic acid, 2-phosphonobutane-1,2,4-tricarboxylic acid, 1-hydroxy-1 -phosphonopropane-1,3,3-tricarboxylic acid, catechol-3,4 -disulfonic acid, sodium pyrophosphate, sodium tetrapolyphosphate, and sodium hexametaphosphate. Particularly preferred among these chelating agents are diethylenetriaminepentaacetic acid, triethylenetetraminehexaacetic acid, 1,3-diaminopropanoltetraacetic acid, glycoletherdiaminetetraacetic acid, hydroxyethylethylenediaminetriacetic acid, 2-phosphonobutane-1,2,4-tricarboxylic acid, 1,1-diphosphonoethane- 2-carboxylic acid, nitrilotrimethylenephosphonic acid, ethylenediaminetetraphosphonic acid, diethylenetriaminepentaphosphonic acid, 1-hydroxypropylidene-1,1-diphosphonic acid, 1-aminoethylidene-1, 1-diphosphonic acid, 1-hydroxyethylidene-1,1-diphosphonic acid, and salts thereof.

In the present invention, the developer may contain as a silver stain inhibitor a compound as disclosed in JP-B-56-46585, JP-B-62-4702, JP-B-62-4703, U.S. Pat. Nos. 4,254,215 and 3,318,701, JP-B-58-203439, JP-B-62-56959, JP-B-62-178247, JP-A-1-200249, EP 507284A and EP 507284A (corresponding to Japanese Patent Application Nos. 3-94955, 3-112275, respectively), and Japanese Patent Application No. 3-233718.

In the present invention, the ascorbic acid and/or derivative thereof is preferably used in combination with a 1-phenyl3-pyrazolidone or p-aminophenol.

Examples of a 3-pyrazolidone developing agent which can be used in the present invention include 1-phenyl-3 -pyrazolidone, 1-phenyl-4,4-dimethyl-3-pyrazolidone, 1-phenyl-4-methyl-4-hydroxymethyl-3-pyrazolidone, 1-phenyl-4,4 -dihydroxymethyl-3-pyrazolidone, 1-phenyl-5-methyl-3 -pyrazolidone, 1-p-aminophenyl-4,4-dimethyl-3-pyrazolidone, 1 -p-tollyl-4,4-dimethyl-3-pyrazolidone, and 1-p-tollyl-4 -methyl-4-hydroxymethyl-3-pyrazolidone.

The preferred amount of the developing agent to be used is normally in the range of 0.001 mol/l to 1.2 mol/l.

Examples of the p-aminophenol developing agent which can be used in the present invention include N-methyl-p-aminophenol, N-(β-hydroxyethyl)-p-aminophenol, N-(4 -hydroxyphenyl)glycine, 2-methyl-p-aminophenol, and p-benzylaminophenol. Particularly preferred among these compounds is N-methyl-p-aminophenol.

The developer of the present invention may contain as an antifoggantnitroindazoles and/or benztriazole and/or 1 -phenyl-5-mercaptotetrazole.

The developer of the present invention may comprise a dialdehyde hardener incorporated therein. Examples of such the dialdehyde compound include glutaraldehyde, α-methylglutaraldehyde, β-methylglutaraldehyde, maleic dialdehyde, succinic dialdehyde, methoxysuccindialdehyde, methylsuccindialdehyde, α-methoxy-β-ethoxyglutaraldehyde, α-n-butoxyglutaraldehyde, α,α-dimethoxysuccindialdehyde, β -isopropylsuccindialdehyde, α,α-diethylsuccindialdehyde, butylmaleindialdehyde, and bisulfite adducts thereof. Most preferred among these compounds are glutaraldehyde and bisulfite adducts thereof.

If the developer contains a dialdehyde compound, its content is preferably in the range of 0.5 to 100 g/l, particularly 0.5 to 30 g/l.

The foregoing nitroindazoles and dialdehyde compounds are liable to gradual deterioration in the developer (usable form). Therefore, in the starting form of the developer, the nitroindazoles and dialdehyde compounds is preferably stored in a neutral or acidic solution separately from the alkaline part containing an ascorbic acid.

The developer according to the present invention preferably exhibits a pH value of from 8.5 to 12, more preferably from 9 to 12.

As the alkaline agent to be used for the adjustment of pH a pH adjustor such as sodium hydroxide, potassium hydroxide, sodium carbonate, potassium carbonate, tribasic sodium phosphate and tribasic potassium phosphate can be used. In addition, a pH buffer as disclosed in JP-A-60-93433 may be used.

Examples of sulfites which can be incorporated as preservatives in the developer of the present invention include sodium sulfite, potassium sulfite, lithium sulfite, ammonium sulfite, sodium bisulfite, and potassium metabisulfite. Such a sulfite can be preferably used in an amount of 0.01 mol/l or more, particularly 0.02 mol/l or more. The upper limit of the amount of such the sulfite to be used is preferably 2.5 mol/l.

In addition, additives as disclosed in L. F. A. Mason, "Photographic Processing Chemistry", Focal Press, 1966, pp. 226–229, U.S. Pat. Nos. 2,193,015, and 2,592,364, and JP-A-48-64933 may be used.

In general, a developer often contains a boric compound (e.g., boric acid, borax) as a pH buffer or the like. However, it is preferable that the ascorbic acid-containing developer be substantially free of boric compound.

The relationship between the presence of a boric compound in the system of the present invention and the effects of the present invention was quite unexpected.

The preparation of the processing solutions to be used in the present invention can be accomplished by methods as disclosed in JP-A-61-177132, JP-A-3-134666, and JP-A-3-67258. The replenishment of the developer in the processing method according to the present invention can be accomplished by a method as disclosed in JP-A-5-216180.

The developer to be used in the present invention may be stored in a packaging material having a small oxygen permeability as disclosed in Japanese Patent Application No. 4-294622.

The fixing solution to be used in the present invention is an aqueous solution containing a thiosulfate having a pH value of preferably not lower than 3.8, more preferably from 4.2 to 6.0.

Examples of the fixing agent to be incorporated in the fixing solution include sodium thiosulfate, and ammonium thiosulfate. The amount of such a fixing agent to be used may be properly altered. The fixing solution may contain a water-soluble aluminum salt which serves as a hardener. Examples of such a water-soluble aluminum salt include aluminum chloride, aluminum sulfate, and potash alum.

The fixing solution may contain tartaric acid, citric acid, gluconic acid or derivatives thereof, singly or in combination. Such a compound may be effectively incorporated in preferably an amount of 0.005 mol or more, particularly preferably 0.01 mol/l to 0.03 mol/l per l of the fixing solution.

If necessary, the fixing solution may contain a preservative (e.g., sulfite, bisulfite), a pH buffer (e.g., acetic acid, boric acid), a pH adjustor (e.g., sulfuric acid), a chelating agent capable of softening hard water or a compound as described in JP-A-62-78551.

In order to accelerate fixing in the processing method according to the present invention, a method as disclosed in JP-A-1-4739, and JP-A-3-101728 may be used.

In the processing method according to the present invention, the photographic material which has been developed and fixed is processed with a rinsing water or stabilizing solution, and then dried.

As the automatic developing machine which can be used in the present invention, any of various types of automatic developing machines such as roller conveyance type and belt conveyance type can be used. The roller conveyance type automatic developing machine is preferred. Further, by employing an automatic developing machine equipped with a developing tank having a small opening rate (preferably not more than 0.04 $cm^{-1}$) as described in JP-A-1-166040 and JP-A-1-193853, the processing can be effected with less air oxidation or evaporation, and the photographic material can be squeezed to fully remove the rinsing water therefrom, i.e., dried via a squeeze roller.

The conveyance rate during the processing in the automatic developing machine is preferably 5 to 80 mm/sec.

It may be further preferred that the rinsing water to be used in the present invention be subjected to pretreatment before being supplied into the rinsing bath, i.e., filtration through a filter member or activated charcoal filter to remove dust and organic substances therefrom.

As antifungal methods there have been well-known an ultraviolet-ray irradiation method as disclosed in JP-A-60-263939, a method using magnetic field as disclosed in JP-A-60-263940, a method which comprises use of an ion-exchange resin to produce pure water as disclosed in JP-A-61-131632, a method which comprises circulating a filter and an adsorbent column with ozone being blown as disclosed in JP-A-4-151143 and Japanese Patent Application No. 2-208638, a method utilizing microbiological degradation as disclosed in JP-A-4-240638, and a method using a microbicide as disclosed in JP-A-62-115154, JP-A-62-153952, JP-A-62-220951, and JP-A-62-209532. These methods may be used in combination with the foregoing pretreatment.

Further, microbiocides, antifungal agents and surface active agents as disclosed in M. W. Beach, "Microbiological Growths in Motion-picture Processing", SMPTE Journal Vol. 85, 1976, R. O. Deegan, "Photo Processing Wash Water Biocides", J. Imaging Tech., vol. 10, No. 6, 1984, JP-A-57-8542, JP-A-57-58143, JP-A-58-105145, JP-A-57-132146, JP-A-58-18631, JP-A-57-97530, and JP-A-57-257244 may be used as necessary.

The rinsing bath (or stabilizing bath) may further contain an isothiazoline compound as described in R. T. Kreiman, "J. Image. Tech.", vol. 10, No. 6, page 242, 1984, bromochlorodimethylhydantoin, an isothiazoline compound as described in Research Disclosure, vol. 205, No. 20526, May 1981, and vol. 228, No. 22845, April 1983, a compound as described in JP-A-62-209532, etc. as a microbicide as necessary.

In addition, compounds as disclosed in Hiroshi Horiguchi, "Bokin Bobai no Kagaku (Chemistry of Microbiocides and Antifungal Agents)", Mitsui Shuppan, 1982, and "Bokin Bobai Gijutsu Handbook (Handbook of Microbicidal and Antifungal Technology)", Nihon Bokin Bobai Gakkai, Hakuhodo, 1986 may be incorporated in the rinsing bath.

The photographic material which has been developed, fixed and rinsed (or stabilized) is then squeezed to fully remove the rinsing water therefrom, i.e., dried via a squeeze roller (preferably at a roller temperature of 70° C. or more). The drying process is effected at a temperature of about 40° C. to about 100° C. The drying time may be properly altered depending on the surrounding conditions. In general, it may be from about 5 seconds to 3 minutes. In a particularly preferred embodiment, the drying process is effected at a temperature of 40° to 80° C. for about 5 seconds to 2 minutes.

If development is effected for not longer than 100 seconds (particularly 20 to 100 seconds) on a dry-to-dry basis, the following treatments can be conducted to inhibit uneven development due to rapid processing. For example, a rubber roller as described in JP-A-63-151943 can be used as a roller at the exit of the developing tank. Further, the rate of agitation of the developer in the developer tank can be controlled to not less than 10 meter/min. in a delivery flow rate as described in JP-A-63-151944. Moreover, agitation can be stronger at least during development than during the waiting period as described in JP-A-63-264758.

In the processing method according to the present invention, the photographic material to be processed is not specifically limited. A commonly used black-and-white photographic material can be mainly used. In particular, the processing method according to the present invention can be applied to photographic material for laser light, printing photographic material, medical X-ray photographic material for direct picture taking, medical X-ray photographic material for indirect picture taking, photographic material for recording CRT image, microfilm, common photographic material for picture taking, etc.

The present invention will be further described in the following examples, but the present invention should not be construed as being limited thereto.

EXAMPLE 1

Preparation of tabular grains

Into a container in which a solution of 6 g of potassium bromide and 7 g of gelatin in 1 l of water had been kept at a temperature of 55° C. were poured 37 ml of an aqueous solution of 4.00 g of silver nitrate and 38 ml of an aqueous solution of 5.9 g of potassium bromide with stirring by the double jet process over 37 seconds. To the emulsion was then added 18.6 g of gelatin. The emulsion was then heated to a temperature of 70° C. where 89 ml of an aqueous solution of 9.8 g of silver nitrate was then added thereto over 22 minutes. To the emulsion was then added 7 ml of a 25% aqueous ammonia. At the same temperature, the emulsion was then subjected to physical ripening for 10 minutes. To the emulsion was then added 6.5 ml of a 100% acetic acid. Subsequently, an aqueous solution of 153 g of silver nitrate and an aqueous solution of potassium bromide were added to the emulsion by the controlled double jet process while the pH value thereof was kept to 8.5 in 35 minutes. The emulsion was then adjusted to a pBr value of 2.8 with an aqueous solution of silver nitrate. To the emulsion was then added a 2N solution of potassium thiocyanate. At the same temperature, the emulsion was then subjected to physical ripening for 5 minutes. The temperature of the emulsion was then lowered to 35° C. As a result, a monodispersed emulsion of pure tabular silver bromide grains having an average grain diameter of 1.10 μm as calculated in terms of projected area, a thickness of 0.165 μm and a diameter variation coefficient of 18.5% was obtained.

Soluble salts were removed from the emulsion by a sedimentation process with Precipitant-1. The emulsion was again heated to a temperature of 40° C. where 30 g of gelatin, 2.35 g of phenoxyethanol and 0.8 g of sodium polystyrenesulfonate as a thickening agent were then added thereto. The emulsion was then adjusted to a pH value of 5.90 and a pAg value of 8.25 with caustic soda and a silver nitrate solution.

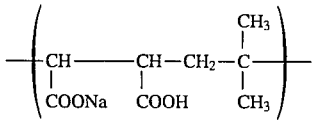

(Molecular weight: approx. 60,000)

The emulsion was then subjected to chemical sensitization at a temperature of 56° C. with stirring. A fine powder of AgI was added to the emulsion before and during the chemical sensitization in an amount of 0.05%, respectively. 0.043 mg of thiourea dioxide was added to the emulsion which was then allowed to stand for 22 minutes to effect reduction sensitization. To the emulsion were then added 20 mg of 4 -hydroxy-6-methyl-1,3,3a,7-tetrazaindene and 400 mg of a sensitizing dye represented by the following formula:

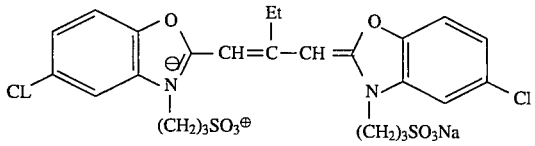

Further, to the emulsion was added 0.83 g of calcium chloride. Subsequently, to the emulsion were added diphenyl(pentafluorophenyl)phosphine selenide, 2.6 mg of chloroauric acid and 90 mg of potassium thiocyanate. After 40 minutes, the emulsion was cooled to a temperature of 35° C.

Thus, the preparation of Tabular Grain T-1 was completed.

Preparation of coating specimen

A coating solution was prepared as a coating specimen by adding the following chemicals per mol of silver halide in Tabular Grain T-1.

| | |
|---|---|
| Gelatin (including gelatin in the emulsion) | 65.6 g |
| Trimethylol propane | 9 g |
| Dextran (average molecular weight: 39,000) | 18.5 g |
| Sodium polystyrenesulfonate (average molecular weight: 600,000) | 1.8 g |
| Hardener (1,2-bis(vinylsulfonylacetamide) ethane | 34 mg |
| [ka-18] | 4.8 g |

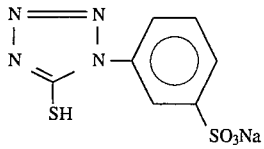

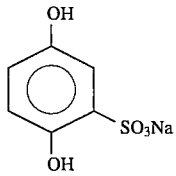

A surface protective layer was prepared in such the manner that various components were coated in the following amounts:

Composition of surface protective layer

| | Coated amount |
|---|---|
| Gelatin | 0.85 g/m² |
| Sodium polyacrylate (average molecular weight: 30,000) | (for adjustment of MT and water content) |
| 4-Hydroxy-6-methyl-1,3,3a,7-tetrazaindene | 0.015 g/m² |
| 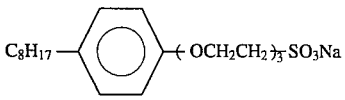 | 0.013 g/m² |
| $C_{16}H_{33}O(CH_2CH_2O)_{10}H$ | 0.045 g/m² |
| $C_{17}H_{33}CON(CH_3)CH_2CH_2SO_3Na$ | 0.0065 g/m² |
| $C_8F_{17}SO_2N(C_3H_7)(CH_2CH_2O)_{15}H$ | 0.003 g/m² |
| $C_8F_{17}SO_2N(C_3H_7)(CH_2CH_2O)_4(CH_2)_4SO_3Na$ | 0.001 g/m² |
| 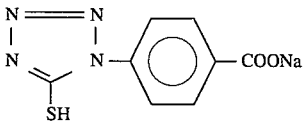 | 1.7 mg/m² |
| Polymethyl methacrylate (average grain diameter: 3.7 μm) | 0.087 g/m² |
| Proxel (adjusted to pH 7.4 with NaOH) | 0.0005 |

Preparation of support (1) Preparation of Undercoating Layer Dye D-1

A dye having the following structural formula was subjected to ball mill treatment by a method as described in JP-A-63-197943:

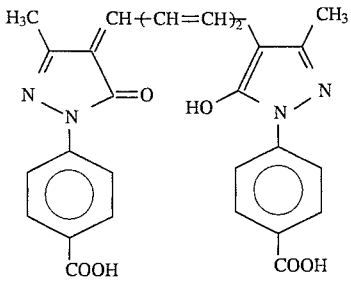

434 ml of water and 791 ml of a 6.7% aqueous solution of a surface active agent TX-200 (available from Triton) were charged into a 2-l ball mill. To the solution was added 20 g of the foregoing dye. To the solution was then added 400 ml of zirconium oxide (ZrO) beads (diameter: 2 mm). The content of the ball mill was then ground for 4 days. Thereafter, to the mixture was added 160 g of 12.5% gelatin. After defoamed, the mixture was then filtered to remove ZrO beads therefrom. The resulting dye dispersion was then observed. As a result, the dye grains were confirmed to have a wide grain diameter distribution ranging from 0.05 to 1.15 μm and an average grain diameter of 0.37 μm.

The dye dispersion was then subjected to centrifugal separation to remove dye grains having a size of not less than 0.9 μm therefrom.

Thus, Dye Dispersion D-1 was obtained.

(2) Preparation of support

A 183-μm thick biaxially-oriented polyethylene terephthalate film was subjected to corona discharge treatment. Onto the polyethylene terephthalate film was then coated a first undercoating solution having the following composition in an amount of 5.1 ml/m$^2$ by means of a wire bar coater. The coated material was then dried at a temperature of 175° C. for 1 minute.

Onto the opposite side (i.e., the back side) of the polyethylene terephthalate film was then coated the first undercoating layer. The used polyethylene terephthalate film was a film that a dye having the following structural formula was contained in an amount of 0.04% by weight:

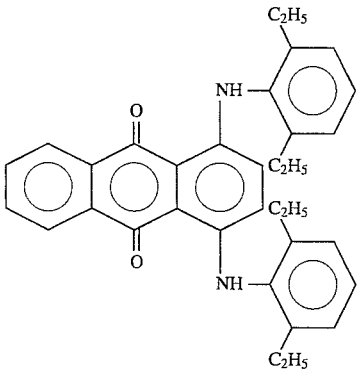

| | |
|---|---|
| Butadiene-styrene copolymer latex solution (solid content: 40%; butadiene/styrene = 31/69 (by weight)) *The latex solution contained | 79 ml |

$(n)C_6H_{13}OOCCH_2$
|
$(n)C_6H_{13}OOCCH—SO_3Na$ as an emulsion dispersant in an amount of 0.4% by weight based on the weight of latex solid content.

-continued

| | |
|---|---|
| 4 wt % solution of 2,4-dichloro-6-hydroxy-s-triazine sodium salt | 20.5 ml |
| Distilled water | 900.5 ml |

Onto the first undercoating layer on both sides of the polyethylene terephthalate film were sequentially coated a second undercoating layer having the following composition by means of a wire bar coater in the following amounts at a temperature of 150° C. The coated material was then dried at a temperature of 150° C.

| | |
|---|---|
| Gelatin | 160 mg/m$^2$ |
| Dye Dispersion D-1 (dye solid content: 26 mg/m$^2$) | |
| 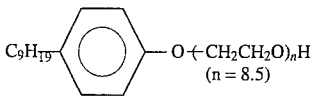 | 8 mg/m$^2$ |
| 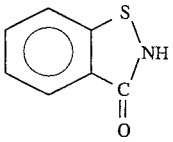 | 0.27 mg/m$^2$ |
| Matting agent (polymethyl methacrylate having an average grain diameter of 2.5 μm) | 2.5 mg/m$^2$ |

Preparation of photographic material

The support thus prepared was then coated with the foregoing emulsion layer and surface protective layer on both sides thereof by the simultaneous extrusion coating method. The coated amount of silver on one side was 1.75 g/m$^2$.

The swelling rate as determined by the coated amount of gelatin and the freeze-drying method with liquid nitrogen was adjusted to 230% by controlling the amount of gelatin and hardener to be incorporated in the emulsion layer.

The specimen thus-obtained was then processed by means of an automatic developing machine CEPROS-M (remodelled version, manufactured by Fuji Photo Film Co., Ltd.). (The automatic developing machine had been remodelled in the drive motor and gear so that the processing time on dry-to-dry basis was adjusted to 30 seconds.)

| Development Replenisher A | |
|---|---|
| Part A | |
| Potassium hydroxide | 15.0 g |
| Potassium sulfite | 30.0 g |
| Potassium carbonate | 55.2 g (0.4 mol/l) |
| Diethylene glycol | 10.0 g |
| Diethylenetriaminepentaacetic acid | 2.0 g |
| 1-(N,N-diethylamino)ethyl-5-mercaptotetrazole | 0.05 g |
| L-ascorbic acid | 43.2 g |
| 4-Hydroxymethyl-4-methyl-1-phenyl-3-pyrazolidone | 2.0 g |
| Water to make | 300 ml |
| Part B | |
| Triethylene glycol | 45.0 g |
| 3-3'-Dithiobishydrocinnamic acid | 0.4 g |
| Glacial acetic acid | 5.0 g |
| 5-Nitroindazole | 0.3 g |

-continued

| Development Replenisher A | |
|---|---|
| 1-Phenyl-3-pyrazolidone | 3.5 g |
| Water to make | 60 ml |
| Part C | |
| 50 wt % Glutaraldehyde | 10.0 g |
| Potassium bromide | 4.0 g |
| Potassium metabisulfite | 10.0 g |
| Water to make | 50 ml |

300 ml of Part A, 60 ml of Part B, and 50 ml of Part C were mixed. Water was then added to the mixture to make 1 l and have pH 10.90.

4.50 l of Part A, 0.90 l of Part B and 0.75 l of Part C were mixed and charged into a bottle CE-DF1 (manufactured by Fuji Photo Film Co., Ltd.). The solution was later used as a 1.5-l usable form.

Development Starting Solution B

Acetic acid was added to the foregoing Development Replenisher A to make pH 10.20. Thus, Development Starting Solution B was obtained.

Development Starting Solution C

Acetic acid was added to the foregoing Development Replenisher A to make pH 10.60. Thus, Development Starting Solution C was obtained.

Development Replenisher D

Development Replenisher D was prepared in the same manner as the foregoing Development Replenisher A, except that the amount of potassium carbonate was altered to 82.8 g/l (0.6 mol/l) to adjust the pH value of the development replenisher in usable form to 10.60.

Development Starting Solution E

Acetic acid was added to the foregoing Development Replenisher D to make pH 10.20. Thus, Development Starting Solution E was obtained.

Development Starting Solution F

Acetic acid was added to the foregoing Development Replenisher D to make pH 10.40. Thus, Development Starting Solution F was obtained.

As the fixing solution, CE-F1 (manufactured by Fuji Photo Film Co., Ltd.) was used.

| | |
|---|---|
| Development temperature | 35° C. |
| Fixing temperature | 35° C. |
| Drying temperature | 55° C. |
| Replenishment rate (for both developer and fixing solution) | 25 ml/10 × 12 inch (325 ml/m$^2$) |

In Experiment Nos. 1,2, 3, 4, 5 and 6 as set forth in Table 1, the 10×12 inch size film was subjected to a 600-sheet running processing with the foregoing development starting solutions and development replenishers, respectively. The results are shown in Table 1.

TABLE 1

| Experiment No. | Development Starting Solution | Development Replenisher | Carbonate concentration | Sensitivity Initial | Sensitivity After 600-sheet running | Remarks |
|---|---|---|---|---|---|---|
| 1 | B (pH 10.20) | A (pH 10.90) | 0.4 mol/l | 80 | 80 | Invention |
| 2 | C (pH 10.60) | A (pH 10.90) | 0.4 mol/l | 93 | 81 | Comparison |
| 3 | A (pH 10.90) | A (pH 10.90) | 0.4 mol/l | 100 | 83 | " |
| 4 | E (pH 10.20) | D (pH 10.60) | 0.6 mol/l | 80 | 80 | Invention |
| 5 | F (pH 10.40) | D (pH 10.60) | 0.6 mol/l | 87 | 81 | Comparison |
| 6 | D (pH 10.60) | D (pH 10.60) | 0.6 mol/l | 93 | 82 | " |

(Note: Experiment Nos. 1 and 4 are according to the present invention while the others are comparative)

The sensitivity was represented as a relative value to the reciprocal of the exposure required to obtain a fog plus black density 1.0 with Development Starting Solution A.

As is apparent from the results of Table 1, Experiment Nos. 1 and 4 advantageously have no sensitivity change from starting time,to after running.

In the present example, the same development process was effected with Fuji medical X-ray films, Super HR-S, Super HR-A, Super HR—C, Super HR-L, Super HR-H, MI-NP and MI-NC and Fuji image-recording films LI-FM and LI-HM. The results were similar to those mentioned above.

EXAMPLE 2

Preparation of specimen

A specimen was prepared in the same manner as in Example 1, except that the amount of the hardener was increased so that the swelling rate was adjusted to 170%.

The automatic developing machine CEPROS-M (manufactured by Fuji Photo Film Co., Ltd.) was remodelled in the drive motor and gear so that the processing time on dry-to-dry basis was adjusted to 30 seconds.

| Development Replenisher G | |
|---|---|
| Diethylenetriaminepentaacetic acid | 4.0 g |
| Potassium carbonate | 55.2 g (0.4 mol/l) |
| Sodium sulfite | 15.0 g |
| Ascorbic acid | 40.0 g |
| 1-Phenyl-4-methyl-4-hydroxymethyl-3-pyrazolidone | 5.0 g |
| 5-Methyl-benztriazole | 0.06 g |

-continued

| Development Replenisher G | |
|---|---|
| 2-Mercaptobenzimidazole-5-sulfonic acid (Compound 23) | 0.05 g |
| 2,3,5,6,7,8-Hexahydro-2-thioxo-4-(1H) quinazolione (Compound 5) | 0.05 g |
| Potassium bromide | 2.0 g |
| Water to make | 1 l |
| pH (adjusted with potassium hydroxide) | 11.00 |

Development Starting Solution H

Acetic acid was added to the foregoing Development Replenisher G to make pH 10.40. Thus, Development Starting Solution H was prepared.

Development Starting Solution J

Acetic acid was added to the foregoing development Replenisher G to make pH 10.60. Thus, Development Starting Solution J was prepared.

Development Replenisher K

Development Replenisher K was prepared in the same manner as the foregoing Development Replenishers G, except that 2-mercaptobenzimidazole-5-sulfonic acid and 2,3,5,6,7,8 -hexahydro-2-thioxo-4-(1H)-quinazolinone to be used as silver stain inhibitors were not used.

Development Starting Solution L

Acetic acid was added to the foregoing Development Replenisher K to make pH 10.40. Thus, Development Starting Solution L was prepared.

Development Starting Solution M

Acetic acid was added to the foregoing Development Replenishers K to make pH 10.60. Thus, Development Starting Solution M was prepared.

As the fixing solution, SR-F1 manufactured by Fuji Photo Film Co., Ltd. was used

| | |
|---|---|
| Development temperature | 35° C. |
| Fixing temperature | 35° C. |
| Drying temperature | 55° C. |
| Replenishment rate (for both developer and fixing solution) | 20 ml/10 × 12 inch (258 ml/m$^2$) |

The results of 750-sheet running are set shown Table 2.

As is apparent from the results of Table 2, Experiment Nos. 7 and 10 according to the present invention advantageously have less sensitivity change between the initial stage and during the running processing. In particular, Experiment No. 7 using a silver stain inhibitor has good results in spite of reduced replenishment rate as small as 258 ml/m$^2$.

Embodiment preferred in the present invention

1. A process for development of a black-and-white silver halide photographic material, which comprises use of a development replenisher for black-and-white silver halide photographic material comprising an ascorbic acid and/or derivative thereof which has a pH value of at least 0.5 higher than that of a development starting solution.

2. A process for development of a black-and-white silver halide photographic material, which comprises use of a development replenisher for black-and-white photographic material comprising an ascorbic acid and/or derivative thereof which has a pH value of at least 0.3 higher than that of a development starting solution and contains a carbonate in an amount of not less than 0.5 mol/l.

3. In the development process as described in the above item 1, the development replenisher is a single-part (i.e., one part) concentrated developer.

4. In the development process as described in the above item 1, the development replenisher consists of 2 or more parts of concentrated developer containing a dialdehyde hardener and a nitroindazole in one part separately from the others.

5. In the development process as described in the above item 1, the silver halide photographic material comprising tabular silver halide grains with an average aspect ratio of from 3 to less than 20 is used.

6. In the development process as described in the above item 2, the silver halide photographic material having a swelling rate of not less than 150% is used.

7. In the development process as described in the above item 1, the amount of silver halide coated on both sides of the photographic material is not more than 3.5 g per m$^2$ as silver content.

TABLE 2

| Experiment No. | Development Starting Solution | Development Replenisher | Silver stain inhibitor | Sensitivity (initial) | Sensitivity (after 750-sheet running) | Silver stain (after 750-sheet running) | Remarks |
|---|---|---|---|---|---|---|---|
| 7 | H (pH 10.40) | G (pH 11.00) | Present | 70 | 71 | E | Invention |
| 8 | J (pH 10.60) | G (pH 11.00) | Present | 83 | 72 | E | Comparison |
| 9 | G (pH 11.00) | G (pH 11.00) | Present | 90 | 74 | E | " |
| 10 | L (pH 10.40) | K (pH 11.00) | None | 80 | 81 | G | Invention |
| 11 | M (pH 10.60) | K (pH 11.00) | None | 93 | 82 | G | Comparison |
| 12 | K (pH 11.00) | K (pH 11.00) | None | 100 | 84 | G | " |

(Note: Experiment Nos. 7 and 10 are according to the present invention while the others are comparative)

The sensitivity was evaluated in the same manner as in Example 1. The degree of silver stain was visually evaluated as follows:

E (Excellent): Little or no change on the roller of the developer tank, etc. from the initial development stage G (Good): Slight but practically insignificant stain on the roller of the developer tank, etc. after 750-sheet running P (Poor): Undesirable stain on the roller of the developer tank, etc.

8. In the development process as described in the above item 1, the silver halide photographic material comprising a monodispersed emulsion of tabular silver halide grains having a grain size of not more than 0.4 μm is used.

9. In the development process as described in the above item 1, the total processing time on a dry-to-dry basis is from 20 seconds to 100 seconds.

10. In the development process as described in the above item 1, the heating means for the roller portion with which the photographic material comes into contact at the stage preceding to the drying zone in the automatic developing apparatus is at a temperature (i.e., a roller temperature) of not lower than 70° C.

11. The development process as described in the above item 2, the automatic developing apparatus used, if equipped with a chemical mixer therein, has a mechanism by which the developer cartridge and the fixing solution cartridge can run out at the same time.

12. In the development process as described in the above item 1, the photographic material made of silver halide grains having a 100 plane/111 plane ratio of not less than 5 comprising an emulsion layer spectrally sensitized to a wavelength range of 600 nm or more and a colored back layer on a transparent support is used.

13. In the development process as described in the above item 1, the photographic material made of silver halide grains having a 111 plane/100 plane ratio of not less than 5 comprising an emulsion layer spectrally sensitized to a wavelength range of 600 nm or more and a colored back layer on a transparent support is used.

14. In the development process as described in the above item 1, the concentrated developer and concentrated fixing solution each consist of one part and are each diluted with water in the respective tank to produce a developer and a fixing solution in usable form which are then supplied as replenishers.

15. In the development process as described in the above item 1, the container for the concentrated developer and the container for the concentrated fixing solution are made of an integrated packaging material.

16. In the development process as described in the above item 1, the automatic developing machine comprising a rinsing bath and a rinse roller (crossover roller) provided between the developing bath and the fixing bath and between the fixing bath and the washing bath is used.

17. In the development process as described in the above item 1, the automatic developing machine comprising various fur inhibitors (microbiocides) in a water stock bath from which water is supplied into the washing bath and rinsing bath is used.

18. In the development process as described in the above item 1, the automatic developing machine comprising a solenoid valve provided at the outlet of the washing bath is used.

19. In the development process as described in the above item 1, the automatic developing apparatus has a multicompartment washing bath which operates in a multi-stage countercurrent process.

20. In the development process as described in the above item 1, the developer and fixing solution are in usable form.

21. In the development process as described in the above item 1, the photographic material comprising silver halide in a coated amount (as silver content) of not more than 3.5 g/m$^2$ is used.

22. In the development process as described in the above item 1, the conveyance rate during the processing in the automatic developing machine is 5 to 80 mm/sec.

23. In the development process as described in the above item 1, the developer contains as a fog inhibitor a nitroindazole and/or benztriazole and/or 1-phenyl-5 -mercaptotetrazole.

24. In the development process as described in the above item 1, the developer comprising an ascorbic acid-containing part contained in a packaging material having an oxygen permeability of not more than 50 ml/atom.day.m$^2$ (as determined at 20° C. and a relative humidity of 65%) is used.

25. In the development process as described in the above item 1, the acid and bromide are added to the development replenisher to produce a development starting solution.

26. In the development process as described in the above item 1, the black-and-white silver halide photographic material has an average iodine content of not more than 0.6 mol % based on the amount of silver, and the total coated amount of binder in the coated layer on one side of the support is not more than 3.0 g/m$^2$.

27. In the development process as described in the above item 1, the black-and-white silver halide photographic material comprises a silver bromochloride, silver chloroiodide or silver bromochloroiodide composition having an average grain.diameter of 0.1 to 0.4 μm and a silver chloride content of not less than 90 mol %.

28. In the development process as described in the above item 1, the developer comprises sodium ions in a proportion of not less than 70 mol % of all cations therein.

29. In the development process as described in the above item 1, the developer has a sulfite ion concentration of at least 0.3 mol/l.

30. In the development process as described in the above item 1, the developer tank of the automatic developing apparatus has an opening rate of not more than 0.04 cm$^{-1}$.

While the invention has been described in detail and with reference to specific embodiments thereof, it will be apparent to one skilled in the art that various changes and modifications can be made therein without departing from the spirit and scope thereof.

What is claimed is:

1. A process for developing an exposed black-and-white silver halide photographic material with an automatic developing machine, which comprises processing the black-and-white silver halide photographic material in a development starting solution and adding a development replenisher solution to the development starting solution, wherein each of said development starting solution and development replenisher solution comprises ascorbic acid and/or a derivative thereof, and the development replenisher solution has a pH value of at least 0.5 higher than that of the development starting solution.

2. A process for developing an exposed black-and-white silver halide photographic material with an automatic developing machine, which comprises processing the black-and-white silver halide photographic material in a development starting solution and adding a development replenisher solution to the development starting solution, wherein each of said development starting solution and development replenisher solution comprises ascorbic acid and/or a derivative thereof and a carbonate in an amount of not less than 0.5 mol/l, and the development replenisher solution has a pH value of at least 0.3 higher than that of the development starting solution.

3. The process as in claim 1, wherein said development replenisher solution contains a silver stain inhibitor represented by formula (I) and/or (II) and the replenishment rate is not more than 300 ml/m$^2$:

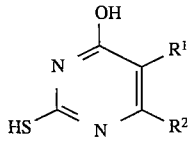

(I)

wherein $R^1$ and $R^2$ each represent a hydrogen atom, an alkyl group, an aryl group, an aralkyl group, a hydroxyl group, a mercapto group, a carboxyl group, a sulfo group, a phosphono group, a nitro group, a cyano group, a halogen atom, an alkoxycarbonyl group, an aryloxycarbonyl group, a carbamoyl group, a sulfamoyl group or an alkoxy group, provided that the sum of the number of carbon atoms contained in $R^1$ and $R^2$ is from 2 to 20; and $R^1$ and $R^2$ may be connected to each other to form a saturated cyclic structure;

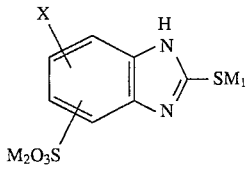

(II)

wherein X represents a hydrogen atom or a sulfonic group; $M_1$ represents a hydrogen atom or an alkaline metal atom; and $M_2$ represents a hydrogen atom, an alkaline metal atom or an ammonium group.

4. The process as in claim 1, wherein said development replenisher solution contains ascorbic acid and/or a derivative thereof in a range of 1 to 100 g per liter.

5. The process as in claim 2, wherein said development replenisher solution contains ascorbic acid and/or a derivative thereof in a range of 1 to 100 g per liter.

6. The process as in claim 3, wherein the development replenisher solution contains said silver stain inhibitor represented by formula (I) and/or (II) in a range of 0.01 to 50 mmol/l.

7. The process as in claim 1, wherein said development replenisher solution contains a 3-pyrazolidone or p-aminophenol developing agent.

8. The process as in claim 1, wherein the development replenisher solution is added to the development starting solution in an amount of not more than 300 ml/$m^2$ of the processed photographic material.

9. The process as in claim 2, wherein the development replenisher solution is added to the development starting solution in an amount of not more than 300 ml/$m^2$ of the processed photographic material.

* * * * *